US006701101B2

(12) United States Patent
Ahn

(10) Patent No.: US 6,701,101 B2
(45) Date of Patent: Mar. 2, 2004

(54) METHOD AND APPARATUS FOR ENHANCING TRANSFER EFFICIENCY OF ELECTRONIC PHOTOGRAPH DEVELOPMENT EQUIPMENT

(75) Inventor: Don-cheol Ahn, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/199,508

(22) Filed: Jul. 22, 2002

(65) Prior Publication Data

US 2003/0113129 A1 Jun. 19, 2003

(30) Foreign Application Priority Data

Dec. 19, 2001 (KR) ..... 2001-81151

(51) Int. Cl.[7] ..... G03G 15/16; G03G 15/20
(52) U.S. Cl. ..... 399/66; 399/45
(58) Field of Search ..... 399/45, 66, 314; 430/126

(56) References Cited

U.S. PATENT DOCUMENTS 6,404,998 B1 * 6/2002 Tanaka et al. ..... 399/66

* cited by examiner

*Primary Examiner*—Hoang Ngo
(74) *Attorney, Agent, or Firm*—Staas & Halsey LLP

(57) ABSTRACT

A method and apparatus for enhancing a transfer efficiency of electronic photograph development equipment, which enhances the transfer efficiency by controlling a transfer voltage output from a transfer voltage output end by a pulse width modulation command under the control of a microcomputer based on a transfer environment and a paper sheet recognition of the electronic photograph development equipment. The transfer efficiency enhancement method includes recognizing a current transfer environment by increasing a transfer voltage up to a predetermined value until a trigger is triggered before a sheet of paper is fed, according to an analog-to-digital conversion value of a fedback transfer voltage, recognizing a sheet of paper by applying a transfer voltage determined by recognition of the transfer environment to a leading end of the sheet of paper, in order to perform recognition and transfer of the sheet of paper, and controlling the transfer voltage based on the output value from an analog-to-digital converter (ADC), which is obtained in a result of the paper sheet recognition, in which the transfer voltage is controlled to become high if the ADC output value is large, but the transfer voltage is controlled to become low if the ADC output value is small. Accordingly, even if resistance of a sheet of paper is not detected or printing is performed in a paper sheet recognition section due to a skew of the sheet of paper, a transfer efficiency having a predetermined value or more, is obtained by using characteristics of an existing high-impedance transfer roller, and also the transfer efficiency can be enhanced by determining a transfer voltage variably according to the resistance of a sheet of paper in comparison with the existing high-impedance transfer method which determines a transfer voltage with only an environmental recognition at a transfer environment recognition.

18 Claims, 5 Drawing Sheets

METHOD AND APPARATUS FOR ENHANCING TRANSFER EFFICIENCY OF ELECTRONIC PHOTOGRAPH DEVELOPMENT EQUIPMENT

CROSS-REFERENCE TO RELATED APPLICATIONS

This application claims the benefit of Korean Application No. 2001-81151, filed Dec. 19, 2001, in the Korean Intellectual Property Office, the disclosure of which is incorporated herein by reference.

BACKGROUND OF THE INVENTION

1. Field of the Invention

The present invention relates to a transfer efficiency enhancement method and apparatus for use in electronic photograph development equipment, and more particularly, to a transfer efficiency enhancement method and apparatus for use in electronic photograph development equipment in which current trigger and paper sheet recognition are combined with an analog-to-digital converter (ADC) by using a high-impedance transfer roller.

2. Description of the Related Art

In general, electronic photograph development equipment is used in copy machines, laser printers, facsimile machines, etc., in which image data captured from a predetermined script or source is exposed to a photosensitive material to form an electrostatic latent image, a developer is deposited on the position where the electrostatic latent image has been formed, to form a visible image, and the visible image is transferred on a printing paper sheet and then fixed thereon to obtain a desired printed image.

The electronic photograph development equipment, which is used in equipment such as copy machines, laser printers, and facsimile machines, is the most widely used apparatus for printing high-resolution images. Although, the electronic photograph development equipment is still expensive, the electronic photograph development equipment is being widely distributed due to remarkable printing performance in areas such as high-speed printing, excellent printing state, and preservation.

According to the transfer characteristics of the electronic photograph development equipment, an appropriate voltage in the electronic photograph development equipment should be applied to a transfer roller so that an image may be transferred in an optimal state. Accordingly, a bad transfer does not occur. In the case that the transfer voltage is low (lower than the optimal state), an electrostatic force is weak and thus toner does not efficiently stick on a sheet of paper. Accordingly, a tremble occurs at the time of transferring. Further, in the case that the transfer voltage is high (higher than the optimal state), the toner on a photosensitive drum is counter-charged with a result that the toner does not stick on the sheet of paper, or an electrostatic force generated from the transfer roller is strong with a result that a toner is transferred on a sheet of printing paper before the printing paper approaches the photosensitive drum, thereby causing the image to be scattered. Thus, only if an appropriate transfer voltage is applied on the sheet of printing paper can a bad transfer be prevented and accordingly a transfer efficiency be enhanced.

Thus, the electronic photograph development equipment is provided with a transfer voltage recognition device which converts a load current flowing through a load of a transfer roller into a voltage, and adjusts a transfer voltage according to a voltage detected by applying a constant voltage of a predetermined level to the conversion voltage, which is obtained by converting the load current flowing through the load of the transfer roller into a voltage.

According to a general transfer environment recognition method, a current flowing through a load is feedback, the fedback current is converted into a voltage, and then the conversion voltage is read. Accordingly, a resistance value of the transfer load is recognized. Then, a final transfer voltage is determined with the resistance value of the recognized transfer load. Thus, a drawback of the contact-type transfer roller sensitive to variation of the transfer environment has been complemented so that a transfer efficiency is optimized.

Basically, two methods exist for sensing (or recognizing) a transfer voltage (or transfer current) and controlling the sensed voltage (or current). The first method is a current trigger method illustrated in FIG. 1, in which a transfer voltage is determined by detecting a voltage which causes a predetermined current to flow through the transfer roller. In this method, a voltage which causes a predetermined current to flow through the transfer roller is detected and then a transfer voltage is determined according to a previously prepared transfer voltage table illustrated in the following Table 1.

TABLE 1

| Detected Voltage (V) | Final Transfer Voltage (V) |
|---|---|
| 500 | 800 |
| 525 | 900 |
| 550 | 1000 |
| . | . |
| . | . |
| . | . |

FIG. 1 shows a transfer timing diagram of a current trigger transfer method, which implements a section obtaining a transfer voltage by increasing a voltage at an initial time until a predetermined current flows through a transfer roller, and another section transferring the determined transfer voltage on a sheet of paper.

The current trigger method has a problem that the transfer efficiency can vary by each sheet of paper because the transfer voltage is determined irrespective of the kind of the sheet of paper. Also, although the resistance of the transfer roller should be high in order to reduce paper sheet deviation, a high-impedance transfer roller may not be triggered in the case of a low-temperature, low-humidity environment.

The second method is a transfer method, which considers a paper sheet resistance as shown in FIG. 2, in which a fixed voltage is applied to a transfer roller to measure a resistance Rtr+Ropc between the transfer roller and developer, and another fixed voltage is applied to a section of a sheet of paper about several millimeters from a leading end of the sheet of paper immediately after the sheet of paper has been advanced in the same manner to measure a system resistance Rtr+Rpaper+Ropc between the transfer roller and the developer, to thereby determine a final transfer voltage. Rtr denotes a resistance of the transfer roller, Ropc denotes a resistance of the developer (OPC), and Rpaper denotes a resistance of the sheet of paper.

FIG. 2 shows a transfer timing diagram of the transfer method considering the resistance of a sheet of paper, which implements a transfer environment recognition section recognizing a resistance between a transfer roller and a developer at an initial time, a subsequent paper sheet recognition section recognizing a resistance of a sheet of paper, and a final section transferring a transfer voltage determined by using a system resistance to the sheet of paper.

The paper sheet recognition transfer method has the following problems. Since a trigger is triggered by only a fixed voltage when a system resistance is recognized only with a transfer roller and a developer before a sheet of paper has been advanced, an area where a trigger can be triggered is narrow. Also, since a deviation in resistance can be large according to a device peripheral environment, determining a fixed voltage can be difficult. Further, since an area where a trigger can be triggered varies according to a magnitude of the applied voltage in view of the circuitry features, determining a voltage at which a trigger can be triggered under all environments can be difficult.

Also, since the system resistance is small, a band may be generated at a halftone in case of a high set voltage under a high-temperature and high-humidity environment, and a positive (+) cleaning effect may be insignificant in case of a low set voltage under a low-temperature and low-humidity environment. Since a transfer voltage is determined by using a resistance recognized immediately after a sheet of paper has been advanced, the resistance of the paper sheet is not accurately recognized in the case that a skew of the paper sheet has occurred. As a result, a transfer efficiency may be sharply lowered. To prevent this phenomenon, the resistance of the transfer roller is made higher than that of the sheet of paper. However, in the case where a high-impedance transfer roller is used, a non-trigger phenomenon may occur under a low-temperature and low-humidity environment.

For this purpose, a transfer voltage controlling technology has been used. According to a conventional transfer voltage controlling method, a predetermined transfer voltage is output from a transfer voltage generator through a pulse-width modulation (PWM) control, and thus a transfer current is sent to a transfer load. The current value is converted into a voltage through a detection resistor. Then, a reference voltage is established so that a comparator is triggered when a current not lower than a preset reference current value flows. Accordingly, a transfer load value is recognized when the comparator is triggered. However, this method should indicate a point in time when the comparator is triggered by sequentially increasing the voltage output from the transfer voltage generator from a lower voltage to a higher voltage through an electronic control PWM increase. As a result, since the range of the transfer resistance is usually wide, to perform a step-up operation can take considerable time. In particular, in this case, if a system runs at high speed, an operational fault may occur. Since a transfer current is fixed as a set current value, and thus the voltage output from the transfer voltage generator is controlled until reaching the reference voltage of the comparator, a deviation due to a load range is very small based on the transfer load operating in proportion with the output voltage irrespective of the range of the transfer load.

As an alternative method, the voltage output from the transfer voltage generator is fixed, and then a feedback current value is detected. Then, the detected current value is converted into a voltage, and the conversion voltage is converted from an analog signal to a digital signal to be read to identify a transfer load. This method will be described in more detail with reference to FIGS. 3A and 3B.

FIG. 3A is a circuit diagram showing a general transfer voltage recognition apparatus. As shown in FIG. 3A, to recognize an actual transfer voltage output from a transfer voltage generator 10, a high-level transfer voltage $V_{THV}$ from the transfer voltage generator 10 is applied to a load resistor $R_L$ that is a transfer load. A voltage detection resistor $R_1$, has one end connected to the transfer voltage generator 10, inserted along a closed circuit path formed by the transfer voltage generator 10 and the load resistor $R_L$, and a variable resistor VR, whose one end is connected to the other end of the voltage detection resistor $R_1$ and has the other end commonly grounded together with the load resistor $R_L$, in order to detect a transfer current $I_L$ incoming to the load resistor $R_L$ as a voltage form. Here, the magnitude of the transfer current $I_L$ applied to the voltage detection resistor $R_1$ can be adjusted with the variable resistor VR so that a level of the voltage $V_S$ (hereinafter called an S-node voltage) detected at a node S which is a common node between the transfer voltage generator 10 and the voltage detection resistor $R_1$ can be adjusted. Also, a constant voltage end $V_{CC}$ is connected to a common node between the variable resistor VR and the voltage detection resistor $R_1$ so that a constant voltage of a predetermined level is applied to a common node between the variable resistor VR and the voltage detection resistor $R_1$ to produce the S-node voltage of the voltage detection resistor $R_1$. Meanwhile, if the S-node voltage detected through the voltage detection resistor $R_1$ is applied to a second operational amplifier OP2 via resistors $R_a$ and $R_b$, the second operational amplifier OP2 performs an integration and amplification function via a feedback resistor $R_C$ and a feedback capacitor $C_1$, with the S-node voltage, so that the S-node voltage is altered into a direct-current voltage of approximately 0–5 V which can be recognized in an analog-to-digital converter (ADC) 20. The analog-to-digital converter (ADC) 20 performs a function of converting the analog voltage output from the operational amplifier OP2 into a digital value. Also, a transfer voltage controller 30 receives the digital value output from the analog-to-digital converter (ADC) 20, and compares the input digital value that is a transfer voltage with a preset reference transfer voltage. Then, if the input digital value and the preset reference transfer voltage differ, the transfer voltage controller 30 applies a pulse-width modulation command corresponding to the difference between the input digital value and the preset reference transfer voltage to a pulse-width modulator 40. Then, when the pulse-width modulator 40 having received the pulse-width modulation command outputs a pulse-width modulation value corresponding to the pulse-width command, a first operation amplifier OP1 amplifies the pulse-width modulation value and applies an amplified result to the transfer voltage generator 10, so that a stable transfer voltage can be supplied. For example, the transfer voltage controller 30 is configured to include a central processing unit 31 correcting a difference between the supplied transfer current and the current detected in the actual load resistor through a pulse-width modulation (PWM) process, and a memory 32 storing a reference transfer voltage digital value and simultaneously storing pulse-width modulation values based on the digital values detected via the analog-to-digital converter (ADC) 20 and the reference transfer voltage digital value in the form of a lookup table (LUT). Although this method is appropriate for a speedy system since the method does not require more time for step-up and triggering than the above-described first method, the transfer efficiency is difficult to distinguish because the difference between the analog-to-digital conversion values and the reference transfer voltage digital value is gradually reduced as the transfer load becomes large, and the difference under a high-impedance environment is also difficult to recognize.

Meanwhile, a transfer control method in electronic photograph development equipment adopting a contact-type roller method has a sensitivity to both of a transfer roller according to a transfer environment and a variation of a transfer condition according to the thickness of a sheet of paper. Accordingly, an environment recognition method controlling the sensitivity of a transfer roller and the variation of a transfer condition is regarded as being important. Thus, a resistance value with respect to the transfer roller is basically read in correspondence to the fluctuation. As a result, the environment is recognized to perform a transfer voltage control. For example, in order to correct an error with respect to sheet thickness of a sheet of paper, typically, the resistance value is read to perform a transfer voltage control appropriate for the resistance value, which is read, when the sheet of paper has advanced between a photosensitive drum and the transfer roller. However, the conventional method has the following drawback in recognizing the thickness of the sheet of paper. That is, when the sheet of paper has advanced between the photosensitive drum and the transfer roller, the conventional method recognizes only the resistance of the advanced sheet of paper irrespective of a size of the sheet of paper. Accordingly, sheets of paper having the same thickness but different size may be recognized as sheets of paper each having a different thickness, which impedes a finite high-voltage control.

To solve the above problems, an electronic photograph development device which improves a recognition degree of a transfer environment is provided, as shown in FIG. 3B. The range of the transfer load is recognized and then a pulse-width modulation output is stepwise applied within the recognized range of the transfer load, to thereby recognize the transfer load. Thus, transfer load recognition at high speed and accuracy is attempted, and the precision of the paper sheet thickness recognition is enhanced through a proportional correction based on the size of an inserted sheet of paper.

As shown in FIG. 3B, a transfer environment recognition apparatus recognizes a transfer environment in existing electronic photograph development equipment. In FIG. 3B, a pulse-width modulator 110 receives a pulse-width modulation command and outputs a pulse-width modulation value. A transfer voltage generator 120 applies a transfer voltage corresponding to the pulse-width modulation value to a transfer load $R_L$. A feedback voltage detector 130 receives a transfer current $I_L$ output from the transfer voltage generator 120 and flowing through the transfer load $R_L$ and converts the fedback transfer current into a voltage via a detection resistor $R_{S1}$, to thereby detect a feedback transfer voltage. A feedback voltage smoothing amplifier 140 smoothes the fedback transfer voltage and amplifies the fedback transfer voltage at a predetermined amplification factor. An analog-to-digital converter 150 converts the analog output from the feedback voltage smoothing amplifier 140 into a digital signal. A trigger point-in-time detector 160 compares a predetermined trigger reference voltage with the output from the feedback voltage smoothing amplifier 140 and detects a point-in-time when the output from the feedback voltage smoothing amplifier 140 becomes larger than the trigger reference voltage as a trigger point-in-time. A paper sheet size recognizer 170 recognizes a size of an advanced sheet of paper. A lookup table (LUT) 180 stores a transfer voltage corresponding to respective transfer loads $R_L$ and the thickness of the sheets of paper as a lookup table. A microcomputer 100 determines a transfer voltage. The microcomputer 100 reads the output from the analog-to-digital converter (ADC) 150 with the output voltage of the transfer voltage generator 120 fixed, and thus calculates an approximate range of the transfer load $R_L$. Then, the microcomputer 100 controls the output voltage of the transfer voltage generator 120 so as to increase stepwise from the lowest value of the approximate range of the transfer load $R_L$, and detects the trigger point-in-time via the trigger point-in-time detector 160. Then, the microcomputer 100 calculates an accurate transfer load $R_L$ using a relationship between the output voltage of the transfer voltage generator 120 and the set trigger current, and calculates the thickness of the paper sheet through a proportional correction according to a ratio of the size of the sheet of paper provided from the paper sheet recognizer 170. Then, the microcomputer 100 determines the transfer voltage corresponding to the calculated transfer load and the thickness of the sheet of paper from the lookup table LUT 180.

Here, the microcomputer 100 measures a no-paper transfer resistance value which is a resistance value between the transfer roller and the photosensitive drum at a state where no paper sheet has advanced, and calculates a non-standard paper sheet transfer resistance value which is a resistance value between the transfer roller and the photosensitive drum at a time when a non-standard paper sheet has advanced. Then, the microcomputer 100 calculates the thickness of a sheet of paper, by using a transfer resistance value obtained by converting the non-standard paper sheet transfer resistance value into a value obtained when a standard sheet of paper of a same thickness has advanced.

In the transfer environment recognition apparatus for use in the electronic photograph development equipment, if a printing signal is input, a light exposure device is driven, a fixing device is heated, and a main motor is driven, to thereby perform a warming-up to print and to subsequently pick-up a sheet of paper. In this case, since a transfer environment should be recognized, a reference transfer voltage is output in order to identify a transfer load $R_L$. Then, the size of a sheet of paper, which is being fed is recognized through a paper sheet size recognizer 170, and provided to a microcomputer 100. The microcomputer 100 having received the recognized paper sheet size information calculates the thickness of the paper sheet accurately through a proportional correction according to the size of the sheet of paper, and then performs a finite high-voltage transfer control for each sheet of paper. However, since an optimal transfer voltage is not calculated depending upon the change of the transfer environment and the result of the paper sheet recognition, a transfer efficiency is lowered.

Meanwhile, a laser beam printer is divided into a cleaner-less system and a cleanable system according to presence or absence of a cleaning member such as a cleaning blade and a cleaning roller. Both the systems require a higher transfer efficiency than a certain degree. Cleanable systems affect the volume of a used toner vessel and a lifetime of a developer directly, while a cleaner-less system causes deterioration of an image, as ghost images are generated.

SUMMARY OF THE INVENTION

An object of the present invention is to provide a transfer efficiency enhancement method and apparatus for use in electronic photograph development equipment which determines a transfer voltage positively according to a transfer environment and a sheet of paper, to thereby obtain a higher transfer efficiency than a predetermined level.

Additional objects and advantages of the invention will be set forth in part in the description which follows and, in part, will be obvious from the description, or may be learned by practice of the invention.

Another object of the present invention is to provide a transfer efficiency enhancement method and apparatus for use in electronic photograph development equipment having a higher transfer efficiency than a predetermined level, in which a system resistance is read by increasing a transfer voltage by a predetermined value with only a value from an analog-to-digital converter at the time of recognizing a transfer environment, and a resistance of a sheet of paper is read by using a circuit which has been used to recognize the transfer environment without focusing on calculation of the thickness of the sheet of paper at the time of recognizing the sheet of paper, to thus apply the voltage value applied to the leading end of the actual paper sheet as a transfer voltage value of the whole sheet of paper.

An additional object of the present invention is to provide a transfer efficiency enhancement method and apparatus for use in electronic photograph development equipment having a higher transfer efficiency than a predetermined level, in which a predetermined voltage is added to or from a voltage applied to the leading end of a sheet of paper by considering a resistance value of a system including the sheet of paper, in proportion with a system resistance, to thereby determine an optimal transfer voltage, in which a high-impedance transfer roller is used to obtain a higher transfer efficiency than a predetermined level even though the system resistance has been recognized as too low before the sheet of paper is fed because of slippage of the sheet of paper.

To accomplish the above and other objects, a transfer efficiency enhancement method for enhancing a transfer efficiency by controlling a transfer voltage output from a transfer voltage generator through a pulse-width modulation command under the control of a microcomputer according to a transfer environment and a paper sheet recognition in electronic photograph development equipment is provided. The transfer efficiency enhancement method comprises: recognizing a current transfer environment by increasing a transfer voltage up to a predetermined value until a trigger is triggered before a sheet of paper is fed, according to an analog-to-digital conversion value of a fedback transfer voltage; recognizing the sheet of paper by applying a transfer voltage determined by recognition of the transfer environment to a leading end of the sheet of paper, in order to perform recognition and transfer of the sheet of paper; and controlling the transfer voltage based on an output value from an analog-to-digital converter (ADC) which is obtained in a result of the paper sheet recognition, in which the transfer voltage is controlled to become high if the ADC output value is large, but the transfer voltage is controlled to become low if the ADC output value is small.

The transfer environment recognition may comprise: tabulating the analog-to-digital conversion value of the fedback transfer voltage which is determined in correspondence to the system resistance and the transfer voltage, in a lookup table; measuring the analog-to-digital conversion values of an actual transfer voltage and the fedback transfer voltage; and finding out the system resistance from the lookup table according to the measured analog-to-digital conversion value, and outputting the system resistance.

Further, the paper sheet recognition may comprise finding out the transfer voltage determined by the system resistance including the recognized resistance of the sheet of paper from the lookup table.

The transfer voltage controlling may comprise adding or subtracting a predetermined voltage with respect to the voltage applied to the leading end of the sheet of paper in proportion with the system resistance according to the analog-to-digital conversion value of the fedback transfer voltage, to thereby determine an optimal transfer voltage.

Also provided is a transfer efficiency enhancement apparatus enhancing a transfer efficiency by controlling a transfer voltage according to a transfer environment and a paper sheet recognition in electronic photograph development equipment, the transfer efficiency enhancement apparatus comprising: a high-impedance transfer roller; a paper sheet resistance recognizer recognizing a resistance of the sheet of paper; a lookup table in which optimal transfer voltages are tabulated according to a system resistance including the resistance of the sheet of paper of the paper sheet resistance recognizer; a transfer voltage generator generating an optimal transfer voltage for the high-impedance transfer roller; an analog-to-digital converter analog-to-digital converting the transfer voltage fedback from the transfer voltage generator and outputting the analog-to-digital conversion value; a trigger point-in-time detector comparing the fedback transfer voltage with a trigger reference voltage and detecting a trigger point-in-time; a microcomputer recognizing a current transfer environment by increasing a transfer voltage up to a predetermined value until a trigger is triggered before a sheet of paper is fed, recognizing a sheet of paper by applying a transfer voltage determined by recognition of the transfer environment to the leading end of the sheet of paper, in order to perform recognition and transfer of the sheet of paper, and referring to the lookup table to find out the optimal transfer voltage, and controlling the optimal transfer voltage from the transfer voltage generator to the high-impedance transfer roller, in which the transfer voltage is controlled to become high if the ADC output value is large, but the transfer voltage is controlled to become low if the ADC output value is small, based on the output value from an analog-to-digital converter (ADC) which is obtained in the result of the paper sheet recognition, and a switching unit connected to the output end of the transfer voltage generator, transferring the transfer voltage to the paper sheet recognizer by a trigger signal from the trigger point-in-time detector.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE INVENTION

Figure 1:
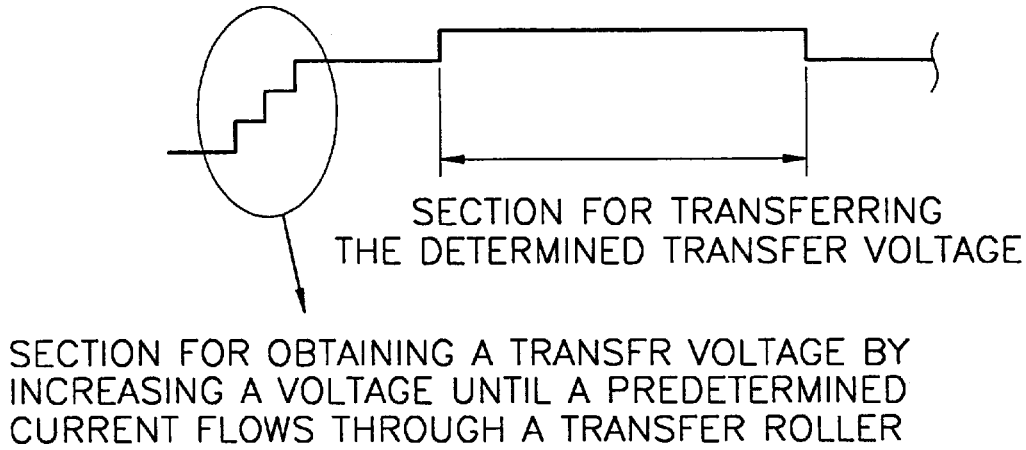
FIG. 1 (PRIOR ART)
FIG. 1 is a transfer timing diagram for explaining a general current trigger transfer method which is used for electronic photograph development equipment.
Figure 2:
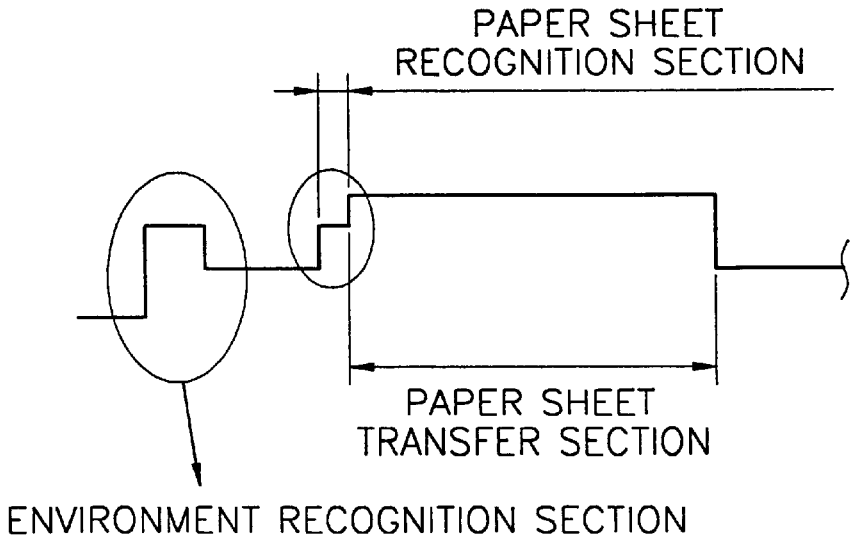
FIG. 2 (PRIOR ART)
FIG. 2 is a transfer timing diagram for explaining a general paper sheet recognition transfer method through measurement of a resistance of a sheet of paper which is used for electronic photograph development equipment.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
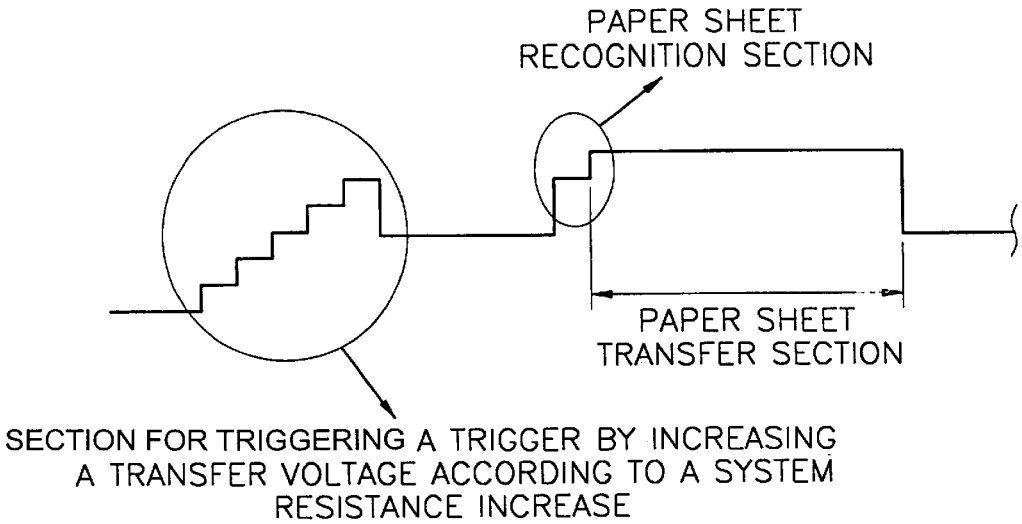
FIG. 4 is a transfer timing diagram for explaining a transfer method employing both a current trigger transfer method and a paper sheet recognition transfer method.

FIG. 4 is a transfer timing diagram for explaining a transfer method employing both a current trigger transfer method and a paper sheet recognition transfer method. Referring to FIG. 4, a transfer efficiency enhancement apparatus in electronic photograph development equipment includes a portion recognizing a current transfer environment by increasing a transfer voltage according to a system resistance increase before a sheet of paper is fed, and triggering a trigger according to an analog-to-digital conversion value, a portion recognizing a resistance of the sheet of paper after a sheet of paper has been fed, and a portion referring to a lookup table to find out an optimal transfer voltage in which optimal transfer voltages have been tabulated in the lookup table according to a system resistance considering the transfer environment and the paper sheet recognition result, to thereby apply the referred optimal transfer voltage on a sheet of paper to be printed. An aspect of the present invention includes both the transfer environment recognition portion and the paper sheet recognition portion, in which optimal transfer voltages are tabulated in the lookup table in correspondence to the analog-to-digital conversion value of the fedback transfer voltage according to the system resistance including the recognized transfer environment and resistance of the sheet of paper, and thus a transfer voltage is positively determined according to the transfer environment and the sheet of paper, to thereby maintain a transfer efficiency of a predetermined level.

Figure 5:
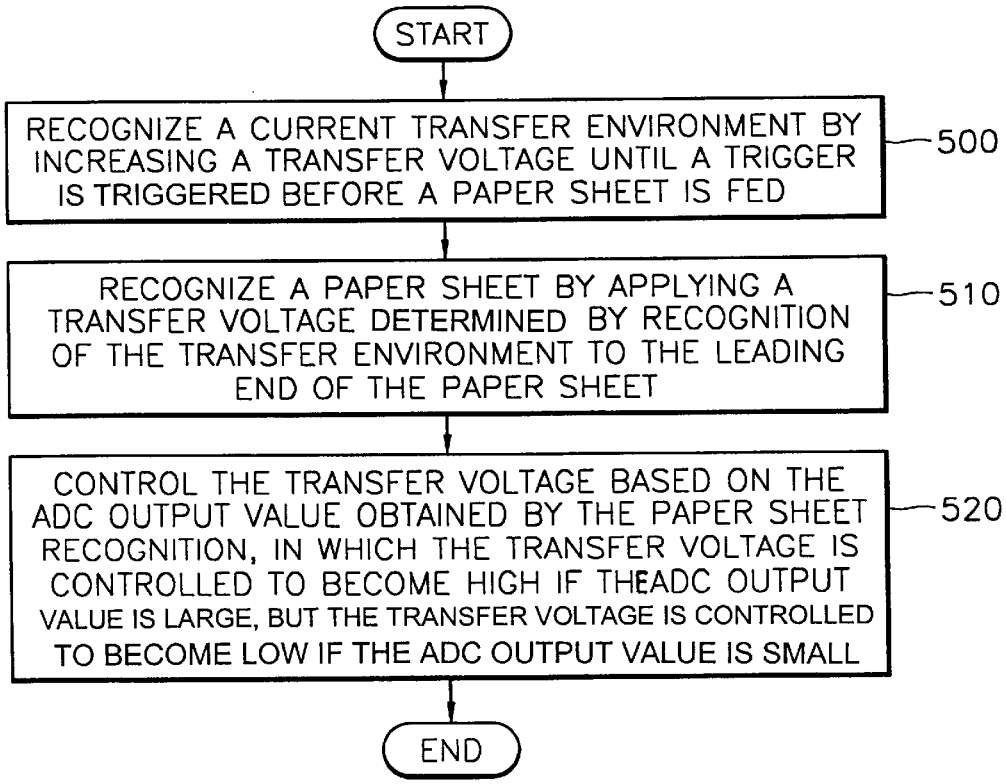
FIG. 5 is a flowchart view for explaining a transfer environment and paper sheet recognition process for explaining a transfer efficiency enhancement method for use in electronic photograph development equipment according to an embodiment of the present invention.

FIG. 5 is a flowchart view for explaining a transfer environment and paper sheet recognition process and for explaining a transfer efficiency enhancement method for use in electronic photograph development equipment. Referring to FIG. 5, a transfer efficiency enhancement method according to the present invention includes a current transfer environment recognition operation 500 of recognizing a current transfer environment by increasing a transfer voltage up to a predetermined value until a trigger is triggered before a sheet of paper is fed, according to an analog-to-digital conversion value of a fedback transfer voltage, a paper sheet recognition operation 510 of recognizing a sheet of paper by applying a transfer voltage determined by recognition of the transfer environment to the leading end of the sheet of paper, in order to perform recognition and transfer of the sheet of paper, and a transfer voltage controlling operation 520 of controlling the transfer voltage based on the output value from an analog-to-digital converter (ADC) which is obtained in the result of the paper sheet recognition, in which the transfer voltage is controlled to become high if the ADC output value is large. However, the transfer voltage is controlled to become low if the ADC output value is small. Referring to FIG. 5, operations 500 to 520 are executed in a microcomputer 100 of FIG. 6. The operation of an embodiment of the present invention will be described in more detail with reference to FIG. 6.

Figure 6:
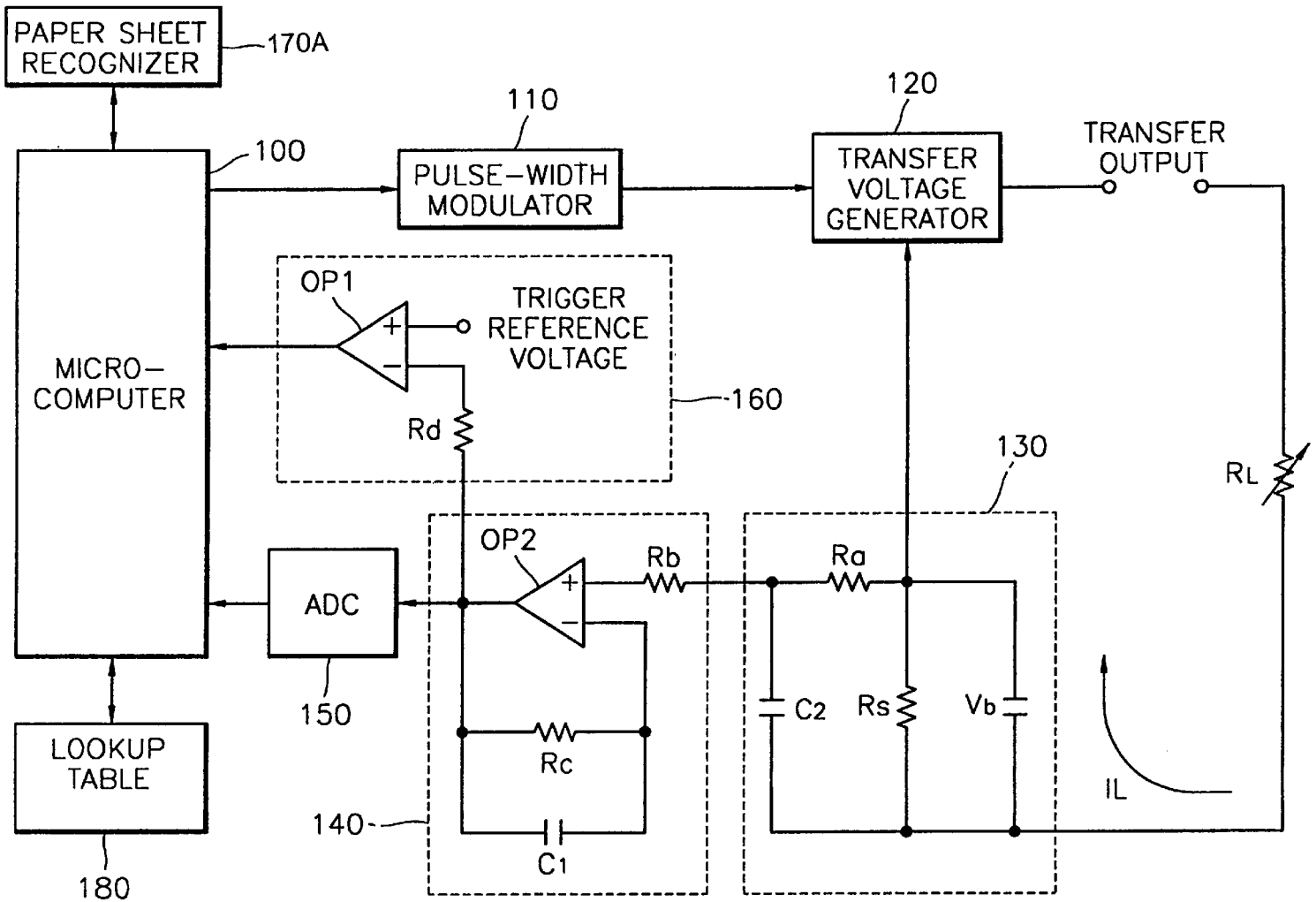
FIG. 6 is a circuitry diagram for explaining a transfer efficiency enhancement apparatus for use in electronic photograph development equipment according to an embodiment of the present invention.

FIG. 6 is a circuitry diagram for explaining a transfer efficiency enhancement apparatus for use in electronic photograph development equipment according to the present invention.

Figure 3A:
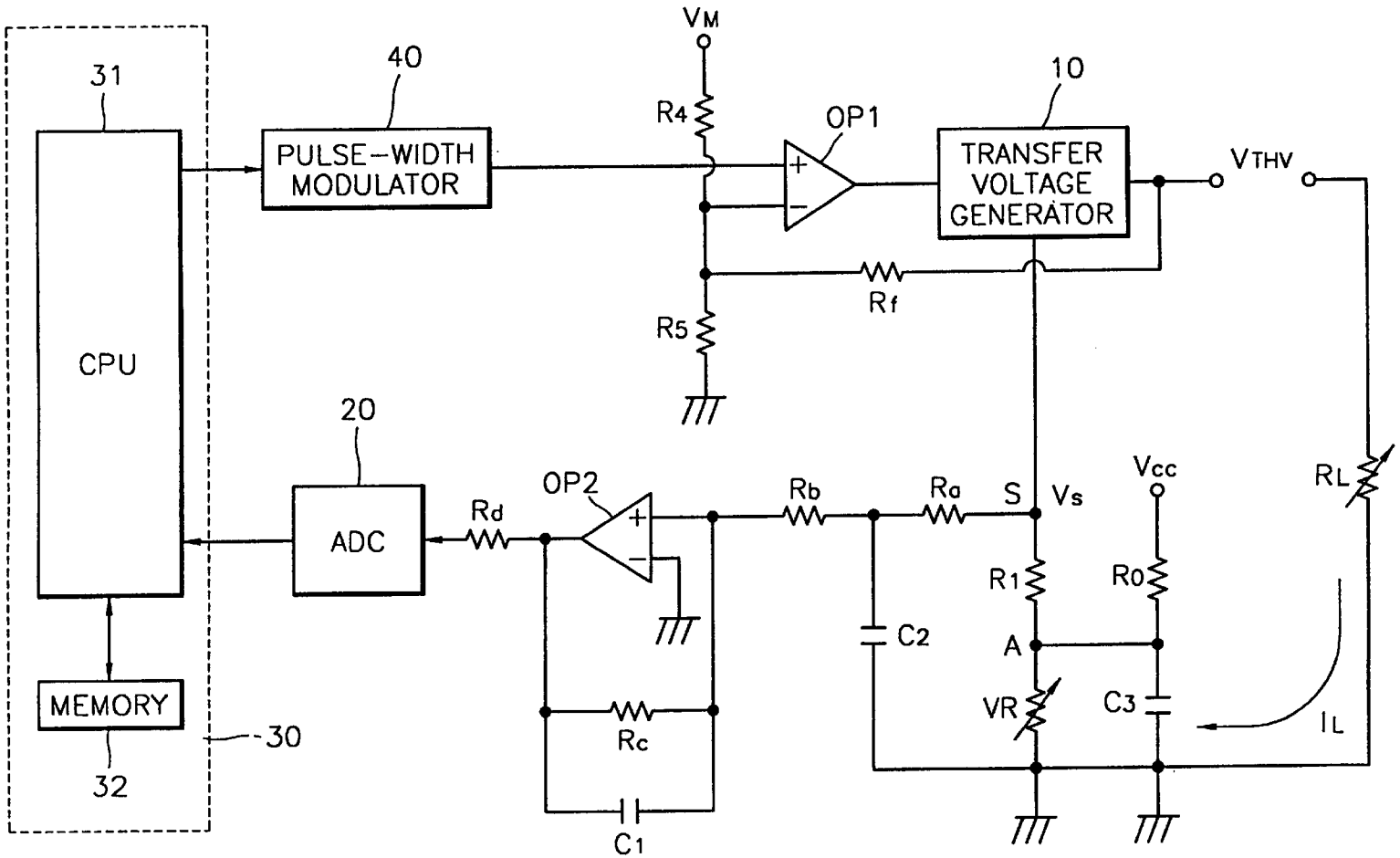
FIGS. 3A and 3B are circuitry diagrams for explaining existing transfer environment recognition processes in electronic photograph development equipment, respectively.
Figure 3B:
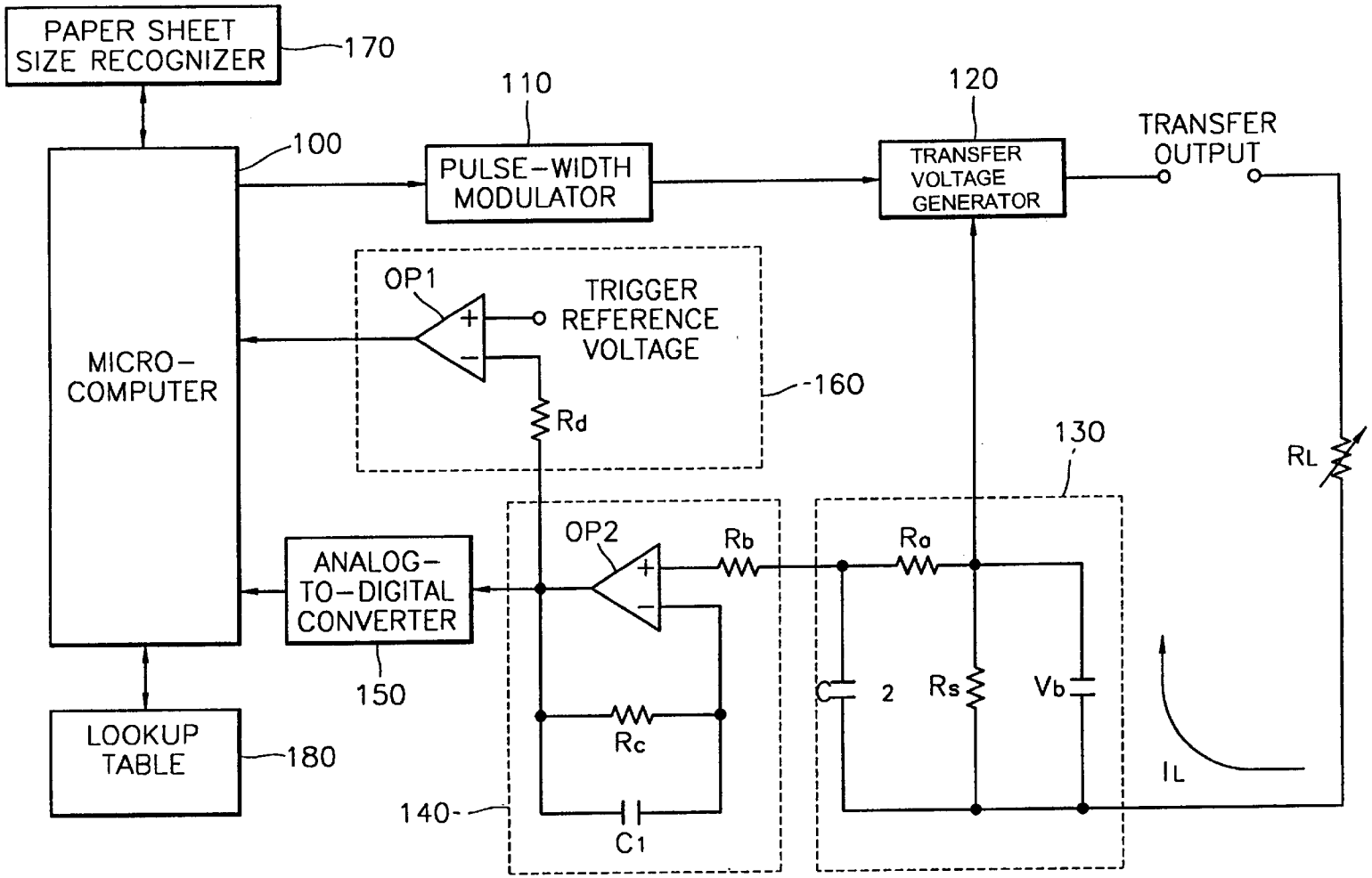

The transfer efficiency enhancement apparatus for use in electronic photograph development equipment shown in FIG. 6 includes some of the same elements as that of FIG. 3B, the detailed descriptions of which will be omitted for brevity.

In the case of the existing technology of FIG. 3B, a system resistance is coarsely read and then a more accurate resistance is calculated by sequentially increasing a voltage from a transfer voltage generator 120, in which the microcomputer 100 uses an analog result obtained by comparing the voltage with a predetermined trigger reference voltage at a comparator OP1 in a trigger point-in-time detector 160 and a digital result obtained from the analog-to-digital converter 150, to thereby determine a transfer environment. However, in the case of the embodiment the present invention as shown in FIG. 6, the microcomputer 100 uses only the output value of the analog-to-digital converter 150 in which the voltage is increased by a predeterminded value to read a system resistance. For this purpose, the present invention stores analog-to-digital conversion values according to predetermined resistance values for each voltage increase step in a lookup table as illustrated in Table 2, in relation with transfer voltages.

A method to produce the lookup table will be described below. A system resistance is measured through a current meter and a direct-current power source after setting a variety of temperatures and humidity conditions under device peripheral circumstances, and then a transfer voltage is varied by using the direct-current power source at the time of performing a printing on an actual sheet of paper, to thereby calculate an optimal transfer voltage. Accordingly, the lookup table is produced by corresponding an optimal transfer voltage to each system resistance. A smooth transferring operation is performed although data is printed on the leading end of a sheet of paper.

TABLE 2

| Resistance/Transfer Voltage (Ω/V) | 500 V | 800 V | 1000 V |
|---|---|---|---|
| 30 | 30 (ADC value) | | |
| 40 | 100 | | |
| 50 | 150 | | |
| 60 | | 40 | |
| 70 | | 70 | |
| 80 | | 110 | |
| 90 | | | 50 |
| 100 | | | 90 |

As illustrated in Table 2, when a transfer voltage of 500V is applied to the transfer roller, an analog-to-digital conversion (ADC) value is 30 for a resistance of 30MΩ, the ADC value is 100 for a resistance of 40 MΩ or the ADC value is 150 for a resistance of 50 MΩ. When a transfer voltage of 800V is applied to the transfer roller, the ADC value is 40 for a resistance of 60 MΩ, the ADC value is 70 for a resistance of 70 MΩ, or the ADC value is 110 for a resistance of 80 MΩ. When transfer voltage of 1000V is applied to the transfer roller, the ADC value is 50 for a resistance of 90 MΩ or the ADC value is 90 for a resistance of 100 MΩ. In this manner, since ADC values are defined for each predetermined voltage, a system resistance value is determined by measuring an actual ADC value. That is, referring to FIG. 6, for example, in the case that a voltage of 500V is applied as a transfer voltage, if an ADC value is 150 or less in the analog-to-digital converter 150, a system resistance is determined as a value between 30 MΩ and 50 MΩ as illustrated in Table 2. For example, in the case that a transfer voltage is 500V, a system resistance is determined as a value between 40 MΩ and 50 MΩ if an ADC value is 120. Otherwise, a voltage of 800V is applied as a transfer voltage. If an ADC value is 110 or less, a system resistance is determined as illustrated in Table 2. For example, if an ADC value is 80, a system resistance is determined as a value between 70 MΩ and 80 MΩ. Otherwise, a voltage of 1000V is applied as a transfer voltage. In this way, a system resistance can be detected. As a result, since a low-resistance band is detected with a low voltage, and a high-resistance band is detected with a high voltage, an accurate resistance can be calculated, and a detectable area can be broadly extended. A transfer environment is primarily recognized before a sheet of paper is fed, and then a transfer voltage is determined through a lookup table if a sheet of paper has been fed. Here, as described above, a voltage applied to the leading end of the paper sheet is a value tabulated in the lookup table through various experiments under the various circumstances by using a high-resistance transfer roller so that a transferring operation of a predetermined transfer efficiency or higher can be performed although any sheet of paper is fed.

Then, a paper sheet resistance recognizer 170A applies the transfer voltage obtained through the transfer environment recognition process to the leading end of the sheet of paper, to thus measure the resistance of the sheet of paper. With reference to the system resistance value including the thus-obtained resistance of the sheet of paper, in particular, according to the ADC value of the analog-to-digital converter 150, the voltage determined by the lookup table stored in the lookup table 180 is applied to the leading end of the paper sheet, and a predetermined voltage is added to or subtracted from the applied voltage in proportion with the system resistance value, to thereby determine an optimal transfer voltage. That is, if an ADC value is high, a high transfer voltage is applied, and if an ADC value is low, a low transfer voltage is applied, based on the ADC value of the analog-to-digital converter 150 after having recognized the paper sheet. The reason is that a higher transfer voltage is needed for sheets of paper with higher resistance. Since the finally determined transfer voltage is obtained by correcting the transfer voltage previously determined through the transfer environment recognition process to a small degree according to the resistance of the sheet of paper, the final transfer voltage is finitely adjusted within the range which does not differ greatly from the voltage applied to the leading end of the paper. The reason is because an offset with respect to the resistance of the sheet of paper can be overcome by finitely adjusting the transfer voltage by use of the high-impedance transfer roller. Accordingly, a transfer efficiency of a predetermined level or higher can be obtained although a very low system resistance is produced as in the case that a system resistance is recognized before a sheet of paper is fed due to slippage of the sheet of paper.

As described above, the existing transfer efficiency enhancement method adopts a digital signal (of an ADC) and an analog signal (by a triggering operation of a comparator) for primarily recognizing a transfer environment. However, the transfer efficiency enhancement method according to the present invention reads a system resistance by increasing a voltage by a predetermined value with only an ADC value, for primarily recognizing a transfer environment. In the case of a secondary paper sheet recognition method, the existing method focuses on calculating the thickness of the sheet of paper but the present invention focuses on reading resistance of the sheet of paper by using the circuit used in the primary transfer environment recognition process. As a result, the present invention determines the voltage to be applied to the actual paper sheet, as a voltage which is reasonable and the voltage is applied as the transfer voltage value for the whole sheet of paper. Accordingly, a transfer efficiency of a predetermined level, according to values in the lookup table, based on the primary transfer environment recognition can be achieved.

As a result, although resistance of a sheet of paper is not accurately detected due to a skew or slippage of the sheet of paper, or data is printed on a paper sheet recognition section, the present invention can maintain a transfer efficiency of a predetermined value or higher due to the existing high-impedance transfer roller. Also, an embodiment of the present invention determines a transfer voltage variably according to resistance of a sheet of paper, to thus heighten the transfer efficiency up to a predetermined level or higher, in comparison with the existing high-impedance transfer method which determines the transfer voltage with only the transfer environment recognition.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A transfer efficiency enhancement method for enhancing a transfer efficiency by controlling a transfer voltage output from a transfer voltage generator through a pulse-width modulation command under the control of a microcomputer according to a transfer environment and a paper sheet recognition in electronic photograph development equipment, the transfer efficiency enhancement method comprising:

recognizing the transfer environment by increasing the transfer voltage up to a predetermined value until a trigger is triggered before a sheet of paper is fed, according to an analog-to-digital conversion value of a fedback transfer voltage;

switching the transfer voltage from the transfer environment to a leading end of the sheet of paper when the trigger is triggered;

recognizing the sheet of paper by applying the transfer voltage determined through recognition of the transfer environment to the leading end of the sheet of paper, in order to perform recognition and transfer of the sheet of paper; and controlling the transfer voltage based on an output value from an analog-to-digital converter (ADC) which is obtained in a result of the paper sheet recognition, in which the transfer voltage is controlled to become a first state if the ADC output value is large, but the transfer voltage is controlled to become a second state different from the first state if the ADC output value is small.

2. The transfer efficiency enhancement method of claim 1, wherein said recognizing the transfer environment comprises:

tabulating in a lookup table the analog-to-digital conversion values of the fedback transfer voltage, which are determined in correspondence to both a system resistance and the transfer voltage;

measuring an analog-to-digital conversion value of the fedback transfer voltage, corresponding to an actual transfer voltage; and finding out the system resistance from the lookup table according to the measured analog-to-digital conversion value, and outputting the system resistance.

3. The transfer efficiency enhancement method of claim 2, wherein said recognizing the sheet of paper comprises:

finding out the transfer voltage determined by the system resistance including a recognized resistance of the sheet of paper from the lookup table.

4. The transfer efficiency enhancement method of claim 3, wherein said controlling the transfer voltage comprises:

adding or subtracting a predetermined voltage with respect to the transfer voltage applied to the leading end of the sheet of paper in proportion with the system resistance according to the analog-to-digital conversion value of the fedback transfer voltage, to determine an optimal transfer voltage.

5. A transfer efficiency enhancement apparatus for enhancing a transfer efficiency by controlling a transfer voltage according to a transfer environment and a paper sheet recognition in electronic photograph development equipment, the transfer efficiency enhancement apparatus comprising:

a high-impedance transfer roller;

a paper sheet resistance recognizer recognizing a resistance of a sheet of paper;

a lookup table in which optimal transfer voltages are tabulated according to a system resistance including the resistance of the sheet of paper of the paper sheet resistance recognizer;

a transfer voltage generator generating a transfer voltage for the high-impedance transfer roller;

an analog-to-digital converter converting the transfer voltage fedback from the transfer voltage generator and outputting an analog-to-digital conversion value;

a trigger point-in-time detector comparing the fedback transfer voltage with a trigger reference voltage and detecting a trigger point-in-time;

a microcomputer recognizing a current transfer environment by increasing the transfer voltage up to a predetermined value until a trigger is triggered before a sheet of paper is fed, recognizing a sheet of paper by applying the transfer voltage determined by recognition of the transfer environment to a leading end of the sheet of paper, to perform recognition and transfer of the sheet of paper, and referring to the lookup table to find out an optimal transfer voltage, and controlling the transfer voltage from the transfer voltage generator to the high-impedance transfer roller to be an optimal transfer voltage, in which the transfer voltage is controlled to become a first state if the ADC output value is large, but the transfer voltage is controlled to become a second state different from the first state if the ADC output value is small, based on an output value from an analog-to-digital converter (ADC) which is obtained in a result of the paper sheet recognition; and a switching unit connected to an output end of the transfer voltage generator, transferring the transfer voltage to the paper sheet recognizer when the trigger point-in-time is detected by the trigger point-in-time detector.

6. A transfer efficiency enhancement method for enhancing a transfer efficiency according to a transfer environment and a paper sheet recognition in electronic photograph development equipment, the transfer efficiency enhancement method comprising:

detecting a system resistance by applying a voltage to a high-impedance transfer roller stepwise from a first voltage to a second voltage different from the first voltage until the system resistance is detected;

switching the voltage from the high-impedance transfer roller to a leading end of a sheet of paper after the detecting of the system resistance;

determining a transfer voltage to be applied to the leading end of the sheet of paper using a predetermined lookup table to recognize resistance of the sheet of paper based on the system resistance; and determining a transfer voltage to be applied to the high-impedance transfer roller after having recognized the resistance of the sheet of paper by having applied the transfer voltage to the leading end of the sheet of paper.

7. The transfer efficiency enhancement method of claim 6, wherein the first voltage is less than the second voltage.

8. A transfer efficiency enhancement method for improving a transfer efficiency in electronic photograph development equipment, the transfer efficiency enhancement method comprising:

recognizing a system resistance by comparing a transfer voltage with a predetermined value and stepwise increasing the transfer voltage until a corresponding detected voltage reaches a predetermined value;

switching the transfer voltage from the transfer environment to a leading end of a sheet of paper when the detected voltage reaches the predetermined value;

evaluating the transfer efficiency by applying the transfer voltage, which corresponds to the detected voltage reaching the predetermined value to a leading end of a sheet of paper to measure a resistance of the sheet of paper; and adjusting the transfer voltage according to both the system resistance and the resistance of the sheet of paper which is being fed.

9. The transfer efficiency enhancement method of claim 8, wherein said recognizing the system resistance comprises:

tabulating analog-to-digital conversion values corresponding to a transfer voltage for a plurality of system resistances;

storing the analog-to-digital conversion values corresponding to the plurality of system resistances in a look up table;

measuring an actual analog-to-digital conversion value based on the analog-to-digital conversion values corresponding to the transfer voltage for an actual transfer voltage; and evaluating the system resistance from the lookup table according to the measured actual analog-to-digital conversion values, and outputting a control signal based on the system resistance.

10. The transfer efficiency enhancement method of claim 9, wherein said evaluating the transfer efficiency comprises:

finding out the transfer voltage determined by the system resistance including the resistance of the sheet of paper from the lookup table.

11. The transfer efficiency enhancement method of claim 8, wherein said adjusting of the transfer voltage is proportional to the system resistance and the resistance of the sheet of paper being fed.

12. The transfer efficiency enhancement method of claim 8, wherein said adjusting of the transfer voltage is based on a feedback circuit having an input controlled by the detected voltage and an output controlling the transfer voltage.

13. The transfer efficiency enhancement method of claim 12, wherein said feedback circuit provides pulse width modulation commands.

14. A transfer efficiency enhancement apparatus for improving a transfer efficiency in electronic photograph development equipment, the transfer efficiency enhancement apparatus comprising:

a high-impedance transfer roller;

a lookup table in which optimal transfer voltage values are stored according to both a system resistance and resistances of sheets of paper;

a transfer voltage generator generating a transfer voltage for the high-impedance transfer roller;

a system resistance recognizer recognizing the system resistance by stepwise increasing the transfer voltage until a corresponding detected voltage reaches a predetermined value;

a paper sheet resistance recognizer recognizing the resistance of one of the sheets of paper by applying the transfer voltage according to the system resistance to a leading end of the sheet of paper and measuring the corresponding detected voltage;

a controller adjusting the transfer voltage to an optimal transfer voltage through the transfer voltage generator according to both the system resistance and the resistance of the sheet of paper which is being fed based on optimal transfer voltage values stored in the look up table; and a switching unit connected to an output end of the transfer voltage generator, transferring the transfer voltage to the paper sheet resistance recognizer when the detected voltage reaches the predetermined value.

15. A storage medium for storing a computer implemented program for improving a transfer efficiency in electronic photograph development equipment, the transfer efficiency enhancement method comprising:

recognizing a system resistance by comparing a transfer voltage with a predetermined value and stepwise increasing the transfer voltage until a corresponding detected voltage reaches a predetermined value;

switching the transfer voltage from the transfer environment to a leading end of a sheet of paper when the detected voltage reaches the predetermined value;

evaluating the transfer efficiency by applying the transfer voltage, which corresponds to the detected voltage reaching the predetermined value, to the leading end of the sheet of paper to measure a resistance of the sheet of paper; and adjusting the transfer voltage according to both the system resistance and the resistance of the sheet of paper which is being fed.

16. The transfer efficiency enhancement method of claim 8, wherein the transfer voltage is determined irrespective of a type of the sheet of paper.

17. A transfer efficiency enhancement method for improving a transfer efficiency in electronic photograph development equipment, the transfer efficiency enhancement method comprising:

determining a transfer environment by increasing a transfer voltage until reaching a threshold;

switching the transfer voltage from the transfer environment to a leading end of an actual sheet of paper when the transfer voltage reaches the threshold; and generating, based on the determined transfer environment the transfer voltage, which is an optimal transfer voltage, to be applied to the actual sheet of paper to provide a transfer efficiency at or above a predetermined level by reading a resistance value of the actual sheet of paper and comparing the resistance value with predetermined values stored in a look up table.

18. A transfer efficiency enhancement method for improving a transfer efficiency in electronic photograph development equipment, the transfer efficiency enhancement method comprising:

generating for each sheet of paper fed into the development equipment a transfer voltage, as an optimal transfer voltage, to be applied to said each sheet of paper to provide a transfer efficiency at or above a predetermined level irrespective of changes in a type of said each sheet of paper being fed by switching the transfer voltage from a transfer environment to a leading end of a sheet of paper when the transfer voltage reaches a threshold and comparing the resistance value of the sheet of paper with predetermined values.

* * * * *